United States Patent [19]

Ingvarsson et al.

[11] Patent Number: 4,599,840

[45] Date of Patent: Jul. 15, 1986

[54] CASSETTE FOR CASTING OF FRAMEWORK

[75] Inventors: Lars I. Ingvarsson; Jonathan A. Ramsden, both of Borlänge, Sweden

[73] Assignee: Dobel AB and Stålbyggnadsinstitutet, Borlänge, Sweden

[21] Appl. No.: 642,679

[22] PCT Filed: Dec. 30, 1983

[86] PCT No.: PCT/SE83/00487

§ 371 Date: Aug. 20, 1984

§ 102(e) Date: Aug. 20, 1984

[87] PCT Pub. No.: WO84/02734

PCT Pub. Date: Jul. 19, 1984

[30] Foreign Application Priority Data

Jan. 3, 1983 [SE] Sweden ..... 8300013-3

[51] Int. Cl.[4] ..... E04B 1/16; E04B 5/18; E04B 5/19

[52] U.S. Cl. ..... 52/340; 52/319; 52/588

[58] Field of Search ..... 52/326, 332, 335, 336, 52/319, 588, 474, 340

[56] References Cited

U.S. PATENT DOCUMENTS

| | | | |
|---|---|---|---|
| 3,276,171 | 10/1966 | Brown | 52/336 X |
| 3,353,313 | 11/1967 | Krysinski | 52/332 X |
| 4,228,624 | 10/1980 | Reneault et al. | 52/588 X |

FOREIGN PATENT DOCUMENTS

| | | | |
|---|---|---|---|
| 1245565 | 7/1967 | Fed. Rep. of Germany . | |
| 1256387 | 12/1967 | Fed. Rep. of Germany . | |
| 2446733 | 4/1976 | Fed. Rep. of Germany | 52/336 |
| 1311704 | 10/1962 | France | 52/588 |
| 90968 | 3/1968 | France . | |

*Primary Examiner*—Stuart S. Levy
*Assistant Examiner*—Lynn M. Sohacki
*Attorney, Agent, or Firm*—Watson, Cole, Grindle & Watson

[57] ABSTRACT

A framework cassette of thin sheet intended to be joined to adjacent cassettes so as to constitute a lost form when casting concrete framework and co-operating with the concrete in the finished framework as regards the absorption of forces. It consists of a rectangular bottom (11) along the two longitudinal sides of which edge beam sections are bent up. These edge beam sections consist in part of an upper, horizontal flange (5), a vertical web (3) with bulges (8) and furthest down a sleeve (6). On the sleeves (6) and between them is located a top section (9) which is also secured to them. The space between the top section (9) and bottom (11) of the cassette can be filled with insulation or used for installation material (14). The concrete is cast over the top section (9) and between the webs (3).

10 Claims, 4 Drawing Figures

FIG. 1
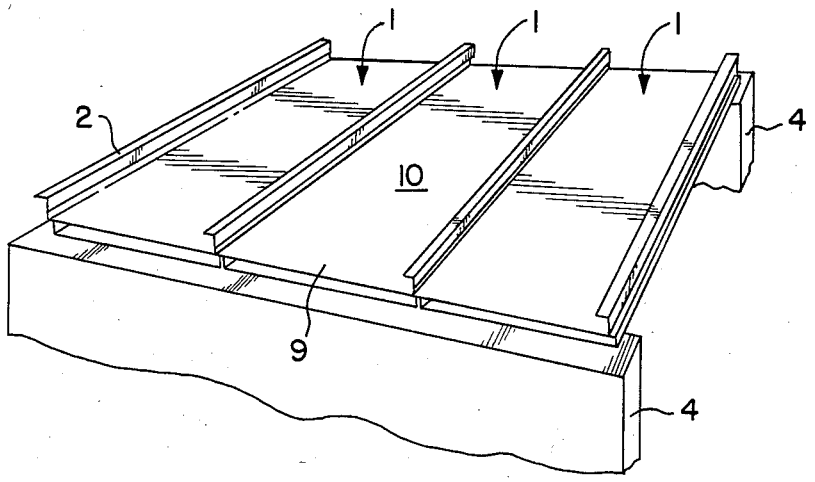
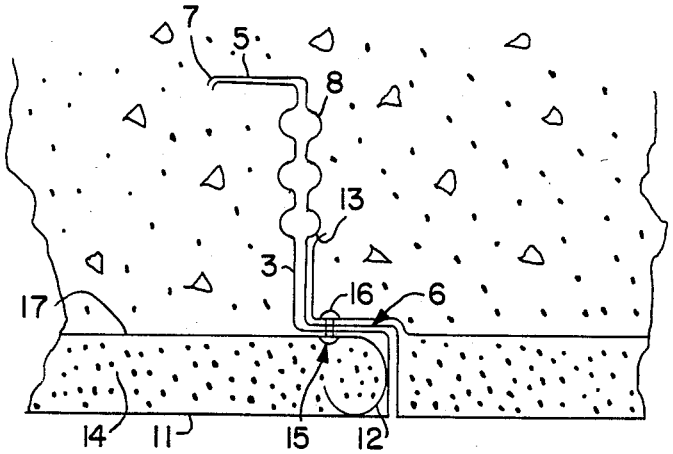
FIG. 2

FIG. 3
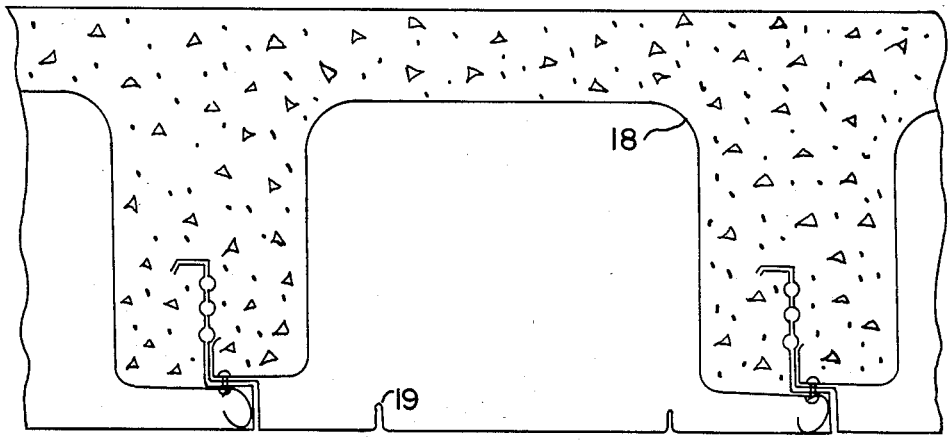
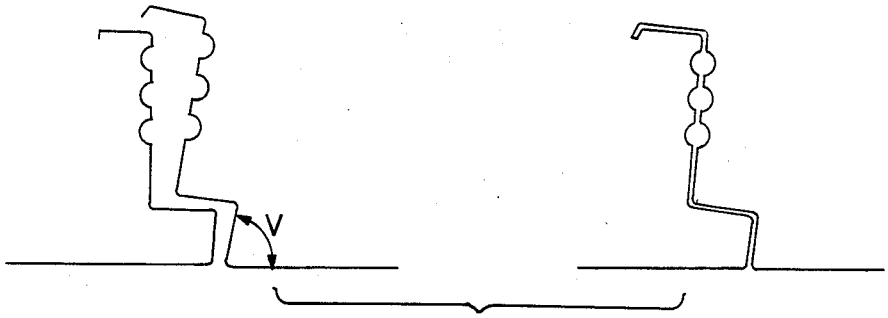
FIG. 4

CASSETTE FOR CASTING OF FRAMEWORK

TECHNICAL SCOPE

The present invention relates to a cassette made of thin sheet or a similar material which is intended to constitute a lost form when casting concrete framework while co-operating with the concrete in the finished framework in the absorption of forces.

BACKGROUND TECHNOLOGY

It has previously been known how to cast framework with the aid of an integral form consisting of cassettes arranged next to one another, whereby the underside of the form constitutes a complete ceiling in the room under the framework. Such a cassette consists of a U-shaped, longitudinal unit of thin steel sheet comprising a rectangular bottom with an edge beam section extending along its respective two parallel longitudinal sides, substantially at a right angle to the bottom on the side which is to be turned up. The said edge beam section comprises both a web rising at a right angle from the bottom and at its upper edge a flange extending at a right angle away from the web and towards the centre on one side of the cassette and away from the centre on its other side. This imparts to the cross-section of the edge beam section a shape enabling adjacent cassettes to be hooked into one another so as to form a continuous framework. The flanges are at their free edges provided with a support edge facing downward, which ensures additional stability and prevents two adjacent units from sliding apart during the casting process.

When casting a framework with the known cassettes by way of a form, their ends are made to rest on the shell of the building, which may consist of a steel shell, temporary support beams resting on temporary piles supporting it along its length. The cassettes in the form are hooked to one another in sequence until the entire area of the framework has been covered. Once the adjacent webs have been joined for instance with the aid of rivets the concrete is applied.

The webs of the edge beam section are provided with holes and aligned with one another in two adjacent edge beam sections, as a result of which the concrete forms a connection along the length of the beams.

The cassettes are subject to tensile forces acting in their plane both during casting and after hardening and loading of the concrete. It is therefore important that the cassettes should be joined with great accuracy. This has proved to be difficult with previously known designs. Apart from a reduced capacity to absorb such tensile stresses the cassettes had a tendency to separate owing to indentations about the rivet heads but also because the fasteners were located too far from the undersides of the cassettes. Furthermore, if a fire broke out, the edge beam sections used also to be in part directly exposed to heat, which is normally not permissible, unless special measures were taken.

Nor are these designs proof against the escape of unbound concrete water while the concrete is being cast, such water being able to flow down on the undersides of the cassettes causing such disfigurations that costly measures could not be avoided.

SUMMARY OF INVENTION

The present invention is intended to provide a framework cassette without any of the disadvantages of the known cassettes, which is easier to install and to join and can also be made sound absorbent instead of being a source for echos. The object has been achieved by the present invention relating to a framework cassette which comprises a preferably rectangular bottom, with an edge beam section extending along its respective two parallel sides, the web thereof being substantially perpendicular to the bottom and whereby the respective edge reinforcement has a cross-section substantially identical with that of a shelf at a slightly higher point on the web. The primary tensile reinforcement consists of the cassette but the invention is also characterised by the fact that an additional section can be provided capable of constituting a tensile reinforcement especially in the transverse direction or constituting an economy device with a view to reducing the amount of concrete, creating space for larger installations and having curves in the web projections, susequently referred to as bulges, so as to bring about a shear connection between the concrete and the sheet while acting as a reinforcement for flat surfaces of the web.

The invention is described in greater detail in the subsequent paragraphs, in the claims and in the attached figures.

DESCRIPTION OF THE DRAWINGS

FIG. 1 showing cassettes in accordance with the invention and resting on a shell, FIG. 2 showing a cross-section of the cassettes casting concrete, FIG. 3 showing a cross-section of the cassettes casting concrete and with an economy device inserted, and FIG. 4 showing edge beam sections before and after joining.

DETAILED DESCRIPTION OF INVENTION

The said edge beam section, 2, comprises both a web, 3, and a flange, 5, at its upper edge as well as a shelf, 6, at a base point of the web, 3, whereby the flange, 5, and the shelf, 6, extend at right angles away from the web, 3, shelf 6 towards the centre, 10, of one side of the cassette, 1, and flange 5 away from the centre, 10, on its other side. The cross-section of the edge beam section, 2, makes it possible as a result for adjacent cassettes, 1, to be hooked to one another to bring about a cohesive and tight concrete form. At least the flange, 5, which is facing away from the centre, 10, of the cassette is at its free edge provided with an edge reinforcement, 7, facing towards the edge plane, whereby a reinforcement of the joints between two adjacent cassettes, 1, is achieved. The said web, 3, also comprises projections or bulges, 8, facing towards the centre, 10, of the cassette, 1, and constituting the main link between the cassette, 1, and the concrete cast in the cassette, 1. The bulges, 8, reinforce also the plane areas of the web, 3, so as to reduce any danger of buckling.

To the cassette may also be added a rectangular top section, 9, intended for placing between the shelves, 6, and covering the space between the webs, 3, of the cassette. One side thereof is curved downward and partly backward and up. The height of the curved part, 12, is prior to mounting somewhat larger than the distance between the underside of the shelf, 6, and the upper side of bottom, 11, of the cassette. For in the course of mounting the curved part, 12, has to be inserted under the shelf, 6, being resiliently pressed together to some extent so as to join tightly to the underside of the shelf, 6, the edge beam section, 2, and the bottom, 11, of the cassette. The opposite side of the top section, 9, is bent up at a right angle and should after mounting in the cassette, 1, follow the side of the web, 3, upward to the lower row of bulges, 8, terminating in an edge bent obliquely inward and upward, i.e. the snap edge, 13, which advantageously snaps fast under the undersides of the bulges, 8. The top section, 9, can be designed either with a substantially flat top surface, 17, which after assembly extends between both webs, 3, of the cassette, 1, or it may have an upward bulging top surface, 18. When casting the concrete it is intended for the top section, 9, to close off the web, 3, and the bottom, 11, of cassette, 1, so as to create a cavity below the top section, 9. The bottom, 11, of the cassette can for instance be perforated through the enclosure so as to achieve a sound-damping effect. The cavity between the bottom, 11, of the cassette and the top section, 9, is advantageously utilised for requisite sound-insulating mats, electricity and heat and ventilation lines etc. If the top section, 9, is made with a flat surface, 17, between the webs, 3, of the cassette, 1, the top section, 9, also acts as a tensile reinforcement in the direction transverse to the longitudinal direction of the cassette, 1. If the upper surface of the cassette, 1, is bent upward, 18, the top section's, 9, capacity to absorb tensile forces is lost but on the other hand space is gained for installations and a lot of concrete is saved, thus above all reducing its weight. The main function of the concrete consists after all in absorbing the pressure loads in the upper sections of the framework and in forming a surface.

When assembling framework cassettes, 1, in order to cast a framework the said cassette, 1, is hooked to the preceding one so that the edge reinforcement, 7, of the upper flange, 5, grips the free edge of the flange below, 5, as a result of which the respective positions of the cassettes, 1, are fixed. Any pipes and lines as well as sound-absorbent mats, 14, are now placed on the bottom, 11, of the cassette, whereupon the curved part, 12, of the top section, 9, is inserted into the recess below one shelf, 6, and fixed to shelf, 6, of the opposite web, 3. The top sections, 9, are secured on the one hand to the horizontal surfaces of the shelves, 6, and on the other hand to the top sections, 9, of adjacent cassettes by means of self-cutting and self-tapping screws or possibly rivets fitted vertically through the shelves, 6, of the said web and two top sections, 9, on the upper or lower side of the shelf, 6. When the top section, 9, is exposed to tensile stresses at a right angle to the longitudinal direction of the edge beam sections, 2, the joint absorbs this stress as a shear stress acting on the fastener. This inter alia means that no indentations are formed about the heads in the sheet. As a result of the arrangement where the webs, 3, and the flanges, 9, are facing the same direction, room is made for modern assembly tools required to bring about the vertical joints. It is advantageous to locate the shelves, 6, at as low a level as possible since, inter alia, projecting parts of the joint actively take part in the co-operation between the concrete and the cassettes, 1. A disadvantage of having the shelf, 6, and the flange, 5, facing in the same direction consists in the fact that the web, 3, tends to be deflected in that direction and subjected to loading. This can be avoided by inclining the web, 2, of the cassettes, 1, the shelf, 6, and flange, 5, of which are located uppermost during assembly, towards the centre, 10, of the cassette, so that the web, 3, forms an angle of 70°–89° with the bottom, 11, of the cassette, see left-hand illustrations in FIG. 4. When the adjacent webs, 3, are joined, see right-hand illustration in FIG. 4, the assembly is inclined. In the loaded state the assembly tends to turn in the opposite direction. As a result the bending resistance of the cassette increases when it is loaded during the casting process since the controlled bending axis coincides with the main axis of inertia of the edge beam section, 2.

As a result an otherwise accelerating stress characteristic is obviated when bending a cassette, 1.

When joining the webs, 3, the bottoms, 11, of the cassettes are bent slightly upward thus compensating any downward bend when they are loaded with concrete or if top sections, 9, are used for installations, etc. With a view to reducing the danger of the bottom, 11, of the cassette buckling, the latter can be provided with grooves, 19. If required the cassette can also be made sound-absorbent by providing its bottom with a dense pattern of holes, preferably also filling the space next to the bottom with an insulating material, 14, such as mineral wool. The insulation can be so selected as to ensure fire protection of the cast framework.

Having completed the assembly of the cassettes, 1, a layer of concrete is poured over the cassettes, 1. After hardening of the concrete a construction results, which is characterised by high carrying capacity. As a result of this design, which causes the joints between the cassettes to be tightly sealed, adjacent webs, 3, are pressed against one another when they are loaded by the flowing concrete, whereas with previous conventional designs where holes were provided to join the webs there was a tendency for the webs to be pressed apart owing to internal excess pressure on the part of the concrete water.

The cassette, 1, forms a tensile reinforcement in the construction as regards bending perpendicularly to the longitudinal direction of the cassette, 1. The top section, 9, constitutes a tensile reinforcement as regards bending parallel to the longitudinal direction of the cassette, 1, and this tensile reinforcement is largely retained even in case of a fire. The bulges, 8, engaging one another and acting as dowels bring about very good shear connection between the cassette, 1, and the concrete. With this design there is practically no danger of shear failure in the shear joint. With correct assembly the casting form will be completely tight. There are no holes in the web causing the concrete water to run out in the joints between the reinforcements, and the load exerted by the concrete compresses adjacent reinforcements, not as used to be the case with previous designs tending to separate them.

We claim:

1. A cassette for use as a lost form when casting concrete therein, said cassette comprising a generally rectangular bottom panel which, when said cassette is positioned for use, extends in a first generally horizontal plane, said generally rectangular bottom panel having opposite first and second elongated side edges, and first and second side walls respectively connected along the length of the first and second side edges of said generally rectangular bottom panel, thus defining inner and outer directions of said cassette, said first side wall comprising a first flange which is connected to said first side edge of said generally rectangular bottom panel and which extends upwardly from said bottom panel in a first generally vertical plane; a second flange which is connected to said first flange and which extends outwardly of said cassette in a second generally horizontal plane;

a third flange which is connected to said second flange and which extends upwardly in a second generally vertical plane, said third flange including vertically spaced apart curved portions which bulge inwardly of said cassette along the length of said third flange; and a fourth flange which is connected to said third flange and which extends outwardly of said cassette in a third generally horizontal plane, said second side wall comprising a fifth flange which is connected to said second side edge of said rectangular bottom panel and which extends upwardly from said bottom panel in a third generally vertical plane; a sixth flange which is connected to said fifth flange and which extends inwardly of said cassette in a fourth generally horizontal plane; a seventh flange which is connected to said sixth flange and which extends upwardly in a fourth generally vertical plane, said seventh flange including vertically spaced apart elongated curved portions which bulge along the length of said seventh flange and inwardly of said cassette; each of said elongated curved portions of said seventh flange being located above said generally rectangular bottom panel at a height equivalent to the height above the generally rectangular bottom panel of the elongated curved portions of said third flange and an eighth flange which extends inwardly of said cassette in a fifth generally horizontal plane.

2. The cassette as defined in claim 1, wherein said generally rectangular bottom panel includes a plurality of upwardly-extending portions which extend along its elongated direction.

3. The cassette as defined in claim 1, including a top section positioned above said generally rectangular bottom panel.

4. The cassette as defined in claim 3, wherein said top section includes a middle portion, a first elongated side edge portion and a second elongated side edge portion, said first elongated side edge portion extending below said sixth flange and being curved downwardly to contact said fifth flange and said generally rectangular bottom panel.

5. The cassette as defined in claim 4, wherein said second elongated side edge portion of said top section includes a first section which extends above said second flange in a sixth generally horizontal plane, and a second section which is connected to said first section and which extends in a fifth generally vertical plane.

6. The cassette as defined in claim 5, wherein said first section of said top section and said second flange of said wall include aligned holes therein and wherein said middle portion of said top section includes holes therein near said first elongated side edge portion, said holes enabling said cassette to be connected to adjacent cassettes by connecting means passing through said holes.

7. The cassette as defined in claim 6, wherein said middle portion of said top section is generally flat and extends in a seventh generally horizontal plane.

8. The cassette as defined in claim 7, wherein a cavity is provided between said generally rectangular bottom panel and said top section, and wherein sound-absorbing material is located with said cavity.

9. The cassette as defined in claim 7, wherein a cavity is provided between said generally rectangular bottom panel and said top section, and wherein fire-resistant material is located with said cavity.

10. The cassette as defined in claim 5, wherein said second elongated side edge portion of said top section includes a third section connected to said second section, said third section extending inwardly of said cassette at an oblique angle, said third section being capable of contacting the lowermost elongated curved portion on said third flange.

* * * * *